US011938367B2

(12) United States Patent
Chang

(10) Patent No.: US 11,938,367 B2
(45) Date of Patent: Mar. 26, 2024

(54) MOUNTABLE ARM ASSEMBLY FOR FITNESS EQUIPMENT

(71) Applicant: Cheng Cheng Chang, Yunlin County (TW)

(72) Inventor: Cheng Cheng Chang, Yunlin County (TW)

(73) Assignee: GLOBAL SOLUTION INTERNATIONAL CO., LTD., New Taipei (TW)

( * ) Notice: Subject to any disclaimer, the term of this patent is extended or adjusted under 35 U.S.C. 154(b) by 248 days.

(21) Appl. No.: 17/500,541

(22) Filed: Oct. 13, 2021

(65) Prior Publication Data

US 2023/0081926 A1 Mar. 16, 2023

(30) Foreign Application Priority Data

Sep. 10, 2021 (CN) ..... 202111062316.X

(51) Int. Cl.
*A63B 21/00* (2006.01)
*A63B 21/06* (2006.01)

(52) U.S. Cl.
CPC ..... *A63B 21/159* (2013.01); *A63B 21/0617* (2015.10); *A63B 21/4035* (2015.10); *A63B 2210/50* (2013.01)

(58) Field of Classification Search
CPC ..... A63B 21/00058; A63B 21/00069; A63B 21/00072; A63B 21/0615; A63B 21/0616; A63B 21/0617; A63B 21/15; A63B 21/159; A63B 21/4033; A63B 21/4035; A63B 23/03508; A63B 23/03516; A63B 23/03533; A63B 23/03541; A63B 23/12; A63B 23/1209; A63B 2208/0233; A63B 2210/00; A63B 2210/50; A63B 2225/09; A63B 2225/093
See application file for complete search history.

(56) References Cited

U.S. PATENT DOCUMENTS

RE23,744 E * 11/1953 Magida ..... A63B 21/015 403/120
2,855,199 A * 10/1958 Noland ..... A63B 23/0494 601/24
3,552,371 A * 1/1971 Kahelin ..... A63B 69/408 124/36

(Continued)

*Primary Examiner* — Gary D Urbiel Goldner
(74) *Attorney, Agent, or Firm* — Chun-Ming Shih; HDLS IPR SERVICES

(57) ABSTRACT

A mountable arm assembly for fitness equipment, comprises two arm members and a connector for pivot connection of the two arm members. The two arm members respectively provide a plurality of assembly portions for length adjustment of the tension arm. The connector is formed with a pivot connection portion and a plurality of eccentric positioning portions. Specifically, an adjustable disposing angle is formed between the two arm members, and the two arm members set the disposing angle through the one the eccentric positioning portions. The arm assembly can be mounted on fitness equipment and can swing back and forth through the pivot connection portion. The users can select one assembly portion on each of the two arm members for required tension arm lengths and add an applied force and a resistance force respectively on the two assembly portions.

16 Claims, 5 Drawing Sheets

(56) References Cited

U.S. PATENT DOCUMENTS 4,357,010 A * 11/1982 Telle ..... A63B 21/4047 482/97
4,405,128 A * 9/1983 Mclaughlin ..... A63B 21/08 601/24
4,407,495 A * 10/1983 Wilson ..... A63B 21/4043 482/138
4,465,276 A * 8/1984 Cox ..... A63B 21/4035 482/126
5,037,088 A * 8/1991 Bernstein ..... A63B 23/12 482/8
5,273,504 A * 12/1993 Jones ..... A63B 23/1263 482/133
5,277,684 A * 1/1994 Harris ..... A63B 23/03533 482/121
5,492,518 A * 2/1996 Measom ..... A63B 21/4047 482/133
5,662,591 A * 9/1997 Peindl ..... A61B 5/224 601/24
5,776,039 A * 7/1998 Perez, Jr. ..... A63B 21/055 482/121
6,443,874 B1 * 9/2002 Bennett ..... A63B 21/4047 128/845
8,267,843 B2 * 9/2012 Dellino ..... A63B 21/4047 482/133
11,458,379 B1 * 10/2022 Leskiff ..... A63B 69/3621
2002/0077227 A1 * 6/2002 Bastyr ..... A63B 21/00192 482/136
2002/0107116 A1 * 8/2002 Schulz ..... A63B 23/1245 482/97
2003/0216229 A1 * 11/2003 Bastyr ..... A63B 21/00185 482/118
2004/0254051 A1 * 12/2004 Harrison ..... A63B 23/1281 482/133
2005/0148445 A1 * 7/2005 Carle ..... A63B 21/08 482/99
2009/0192026 A1 * 7/2009 Mason ..... A63B 21/4035 482/97
2010/0099542 A1 * 4/2010 Fernandez ..... A63B 22/203 482/142
2010/0248909 A1 * 9/2010 Thorpe ..... A63B 23/0211 482/91
2013/0023389 A1 * 1/2013 Olson ..... A63B 21/4035 482/121
2013/0225378 A1 * 8/2013 Burek ..... A63B 26/00 482/142
2014/0128229 A1 * 5/2014 York ..... A63B 21/078 482/104
2016/0193495 A1 * 7/2016 Nelson ..... A63B 21/4035 600/595
2017/0319905 A1 * 11/2017 O'Connor ..... A63B 21/00181
2018/0098905 A1 * 4/2018 Nelson ..... A63B 23/0494
2021/0402245 A1 * 12/2021 Horvath ..... A63B 21/0626
2022/0193523 A1 * 6/2022 Schaefer ..... A63B 21/4035

* cited by examiner

MOUNTABLE ARM ASSEMBLY FOR FITNESS EQUIPMENT

BACKGROUND OF INVENTION

1. Field of the Invention

The present invention relates generally to an arm assembly for fitness equipment, and more particularly to an arm structure facilitating the users to select tension arm length, disposing angle and equipment to be mounted on, and specifically to a mountable arm assembly for various types of fitness equipment.

2. Description of Related Art

In conventional fitness equipment, especially those strength training apparatuses like rowing, pedaling, jogging, or lifting devices for users to exercise limbs or different muscle groups, arm members are commonly used as the force transmission component for the users to add applied force and load resistance force. One end of the arm member is used as the applied force end for the limb of the users to add a force, whereas the other end of the arm member is used as the resistance force end to load a resistance force source selected by the users. The resistance force end can be a load (such as a counterweight iron), or a resistance force device like a motor or a power-driven machine, or just the self-weight of the user. Such resistance force sources are used to generate a resistance force.

The above-mentioned fitness apparatuses are all customized to exercise specific muscle groups. Whether such apparatuses can be used to exercise muscle groups in one single part or in multiple parts of the body, generally the users can only choose from different resistance forces loaded on the resistance force end of the arm member, the length of the tension arm provided by the arm member is generally fixed and cannot be adjusted. Even if the length of the tension arm can be adjusted, the range of adjustment is limited. Therefore, such apparatuses are actually inconvenient for users to use.

Also, it is commonly seen that the arm member is usually in the form of a straight or bent arm body to form a disposing angle, and one arm member or multiple arm members connected to each other are pivoted on fitness equipment. However, the straight or bent disposing angle formed on one single arm member, or the disposing angle formed between multiple arm members pivoted to each other is determined by the designer, and the users cannot adjust the disposing angle as needed.

Therefore, the custom-made arm members mounted on fitness equipment for specific exercising purposes do not provide free adjustment of the tension arm length or the disposing angle. The fixed structure even affects the range of torque that can be generated by the arm member, as well as the range of applied forced needed for exercising the user's limb, thus influencing the overall effectiveness of the fitness equipment. Moreover, it is usually not possible to change the position of installation for the arm member, particularly to install it on fitness equipment for different exercising purposes. Such arm members are generally lack of the versatility of modular installation and are therefore in need of improvement.

SUMMARY OF THE INVENTION

In view of the problems of the conventional arm members, one object of the present invention is to provide a solution to extend the range of applied force to exercise the muscle strength of the users on one single fitness apparatus based on different training intensities of different users, so that one single fitness apparatus can meet the exercising needs of different users, or for different muscle groups. Therefore, the present invention firstly puts aside the variation of load to be selected by the users on the resistance force end, and focuses on improving the arm member commonly installed on fitness equipment through a solution to enhance the adjustability of the arm member to generate different torques, so as to extend the range of applied force for the users to exercise muscle strength. The inventor has developed an arm assembly for fitness equipment offering adjustment of both the tension arm length and the disposing angle according to the need for different training intensity, thus overcoming the problem that the arm members of the conventional fitness apparatuses do not offer convenient change of the tension arm length or the disposing angle.

A further object of the present invention is to improve the modularity of the arm assembly for better convenience, and particularly to enable modular installation for creating fitness equipment for multiple purposes to exercise different limbs or muscle groups.

In order to realize the above objects in a united form, in one embodiment, the present invention provides a mountable arm assembly for fitness equipment, comprising two arm members and a connector; the arm bodies of the two arm members are respectively formed with a plurality of assembly portions distributed at intervals and having different tension arm lengths; the connector is formed with a center-positioned pivot connection portion and a plurality of eccentric positioning portions distributed at intervals around the pivot connection portion; specifically, the two arm members are interconnected via the connector, such that an adjustable disposing angle is formed between the two arm members, and at least one of the two arm members defines the disposing angle through at least one of the eccentric positioning portions. The arm assembly can be mounted on fitness equipment by the pivot connection portion and can swing back and forth. Users can select from different assembly portions on the two arm members for different tension arm lengths needed to add an applied force and a resistance force.

In a further embodiment, the two arm members comprise an applied force arm and a resistance force arm with interchangeable installation positions.

Each of the plurality of assembly portions of the applied force arm is respectively defined as an applied force assembly portions, each of the plurality of different tension arm lengths is defined as an applied force arm length formed between the plurality of applied force assembly portions and the pivot connection portion, and each of the plurality of applied force assembly portions can be mounted with an applied force member, so as to add an applied force to the arm assembly.

Specifically, the applied force member is at least one of a handle, a pedal, a bar, a mat, a frame, or a rope for the users to touch and apply a force. The plurality of applied force assembly portions are in the form of holes. The applied force member is connected to any of the applied force assembly portions through any of a bolt, a pin, or a hook for an expected applied force arm length.

Each of the plurality of assembly portions on the resistance force arm is respectively defined as a resistance force assembly portions, each of the plurality of different tension arm lengths is defined as a resistance force arm length formed between the plurality of resistance force assembly portions and the pivot connection portion, and the plurality of resistance force assembly portions are provided for installation of a resistance force member to add a resistance force to the arm assembly.

Specifically, the resistance force member is at least one of a weight plate, a dumbbell, an elastic rope, a hydraulic cylinder, a pneumatic cylinder, a spring, a motor, the self-weight of the user, or a water bucket to generate a pulling force upon the resistance force arm. The plurality of resistance force assembly portions are in the form of holes. The resistance force member is connected to or touches any of the resistance force assembly portions of the required resistance force arm length through any of a bolt, a pin, a hook, a bar, a rope, or any part of the user's body.

In a further embodiment, the connector is made in the form of a rotary disc, the rotary disc comprises a disk body and a first disc cap, the pivot connection portion and the plurality of eccentric positioning portions are all located on the disk body, the first disc cap is formed with a first supporting portion and a first limiting portion; specifically, the first supporting portion is located at the center of the first disc cap and corresponds to the pivot connection portion for interconnecting with each other, the first limiting portion is located on the periphery of the first supporting portion and can fit upon one of the plurality of eccentric positioning portions, so that the first disc cap can be configured on the rotary end face on one side of the disk body at a required disposing angle; and one end of the two arm members is respectively fixed on the disk body and the first disc cap, such that the two arm members are pivoted together through the disk body and the first disc cap and form a disposing angle.

Specifically, the first supporting portion and the first limiting portion are integrally formed with the end portion of the arm member that is fixed on the first disc cap. The pivot connection portion and the first supporting portion can be presented in the form of interconnected hole-to-hole, and the equipment provides a support shaft for pivot joint with the pivot connection portion. The first limiting portion and the eccentric positioning portions are configured in the form of matching holes, so that the first limiting portion and the eccentric positioning portions can be fixed together through a first pin going through the holes while defining the disposing angle. The first pin is accompanied with an elastic component when going through the holes of the first limiting portion and the eccentric positioning portions to fix them together.

Specifically, the connector also comprises a second disc cap, the second disc cap is formed with a second supporting portion and a second limiting portion, the second supporting portion is located at the center of the second disc cap and corresponds to the pivot connection portion for interconnecting with each other, the second limiting portion is located on the periphery of the second supporting portion and can fit upon one of the plurality of eccentric positioning portions, so that the second disc cap is configured on the rotary end face on the other side of the disk body in a manner enabling selection of the limiting point. The pivot connection portion and the second supporting portion can be presented in the form of interconnected hole-to-hole, and the equipment provides a support shaft for pivot joint with the pivot connection portion and the second supporting portion. The second limiting portion and the eccentric positioning portions are configured in the form of matching holes, so that the second limiting portion and the eccentric positioning portions are interconnected via a second pin to determine the limiting point. One end of the second pin extends outward to form a stopping column, so that the stopping column can swing along with the arm assembly. The equipment also provides a stopping portion that can limit the swing angle of the stopping column. The stopping portion is located at a close eccentric position on the support shaft.

In a further embodiment, the arm assembly is a pair, and is symmetrically installed on the two sides of the equipment.

In a further embodiment, the equipment is one of a fitness apparatus, a support frame, or a door frame.

Based on the descriptions above, the present invention offers the following technical features and effects:

1. The two tension arms provide a full 360-degree, equal-circumference area as the range of adjustment for the disposing angle, so that the users can freely select a required disposing angle between the two tension arms according to different training targets and exercising purposes. An appropriate applied force angle or resistance force angle, or an appropriate range of angles can be selected to improve the exercising efficiency for the specific limbs.

2. The connector for pivot joint of the two arm members provides a plurality of eccentric positioning portions, so that the users can easily position (i.e. lock) and release (i.e. unlock) the above selected disposing angle.

3. Through the plurality of assembly portions of different tension arm lengths provided by the two tension arms, which particularly comprises a plurality of applied force assembly portions and a plurality of resistance force assembly portions, the users can select the tension arm lengths of the applied force and the resistance force. Thus, the range of adjustment for the tension arm length is extended.

4. The users can easily select an applied force member suitable for the applied force assembly portion of the required applied force arm length, and select a resistance force member suitable for the resistance force assembly portion of the required resistance force arm length to create a required load for different body building purposes or to match a specific fitness apparatus.

5. Based on the pivot connection portion provided by the connector, and the technical feature of adjustability of both disposing angle and tension arm length of the arm assembly, the arm assembly of the present invention can be easily modularized to create fitness apparatuses for multiple purposes, and users can freely define the part of body to be exercises or the intensity of exercise by themselves.

The features and technical effects of the embodiments disclosed above will be further detailed in the subsequent descriptions with reference to the accompanying drawings.

DETAILED DESCRIPTION OF THE INVENTION

Figure 1:
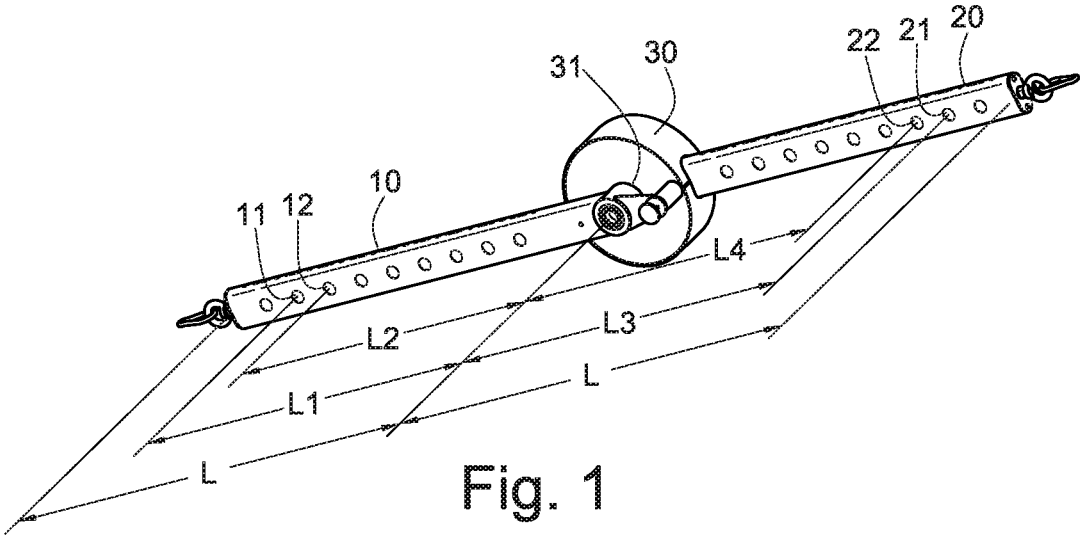
FIG. 1 is a perspective view of the present invention of an arm assembly for fitness equipment.

First, referring collectively to FIG. 1 to FIG. 4, which disclose a preferred embodiment of the arm assembly for fitness equipment according to the present invention, as shown in FIG. 1, the arm assembly comprises two arm members and a connector 30; specifically, based on differentiated purposes during exercise for adding an applied force to the arm assembly by the users or loading resistance force onto the arm assembly, the two arm members are comprised of an applied force arm 10 and a resistance force arm 20, and the applied force arm 10 and the resistance force arm 20 are pivoted together through the connector 30 to form the arm assembly, so that an adjustable disposing angle α (to be detailed later) is formed between the applied force arm 10 and resistance force arm 20.

The applied force arm 10 and resistance force arm 20 can be made of metal or non-metal materials with appropriate tension strengths to resist pressing or pulling, and preferably light-weight materials, and can be made in the form of a hollow or solid arm body.

As disclosed in FIG. 1, the applied force arm 10 and resistance force arm 20 can be implemented as a straight bar-shaped body having an obvious tension arm length L, but is not limited to this. The two arm members can also be made into a bent bar-shaped or a disc-shaped body; in other words, whether the applied force arm 10 and resistance force arm 20 are made in the form of a straight, bent or disc-shaped body, as long as they can respectively correspond to a pivot connection portion 31 at the center of the connector 30, and have a tension arm length L presented by projection (cos θ), and the tension arm length L is perpendicular to the direction of the applied force (including pulling force or pushing forced applied by the user) and the resistance force (including pulling resistance force or pushing resistance force applied by the resistance force source), and the applied force and resistance force are respectively produced by a positive force or by projection of force components, such cases all fall within the application range of the present invention.

As disclosed in FIG. 1, the two arm members are respectively formed with a plurality of assembly portions spaced between each other and having different tension arm lengths. Further, based on the differentiated purposes to add applied force or load resistance force, the assembly portions comprises a plurality of spaced applied force assembly portions 11, 12 formed on the arm body of the applied force arm 10, and a plurality of spaced resistance force assembly portions 21, 22 formed on the arm body of the resistance force arm 20. The tension arm length comprises applied force arm length and resistance force arm length (to be detailed later).

Figure 2:
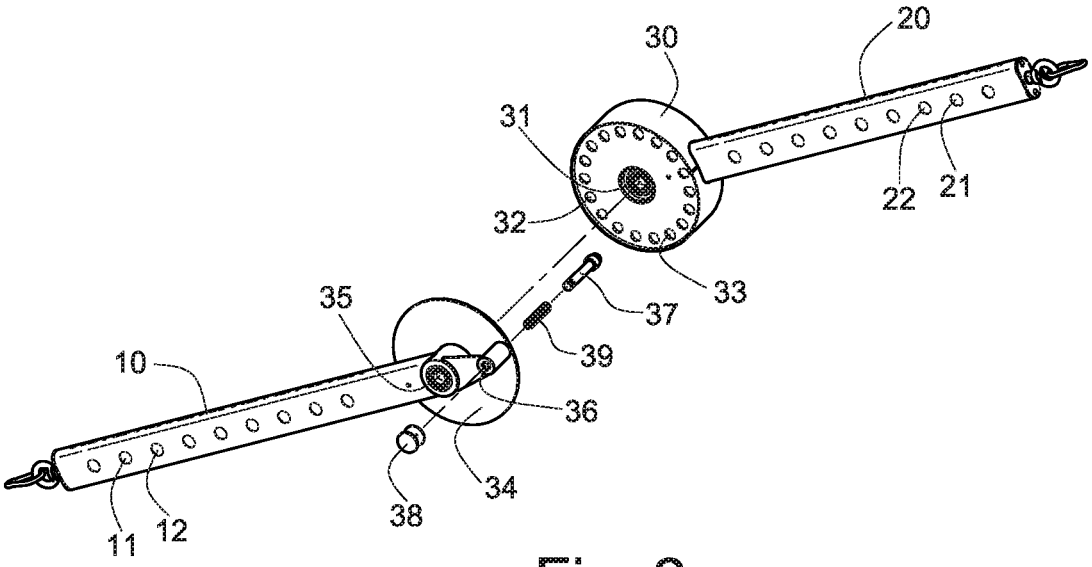
FIG. 2 is an exploded perspective view of FIG. 1.
Figure 3:
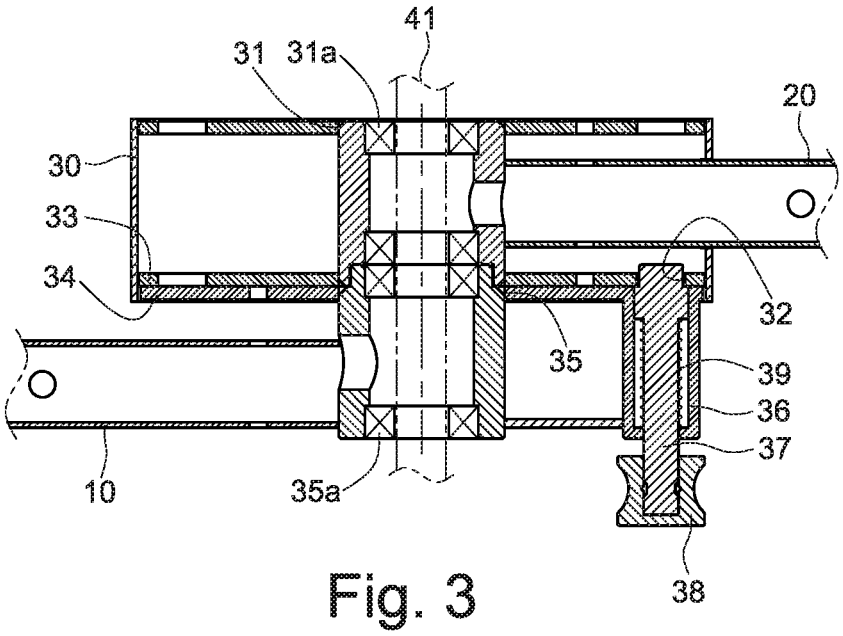
FIG. 3 is a partial sectional view of FIG. 1.

As disclosed in FIG. 2 and FIG. 3, the connector 30 can be implemented as a rotary disc, and the connector 30 is formed with a center-positioned pivot connection portion 31 and a plurality of eccentric positioning portions 32 distributed at intervals around the pivot connection portion 31. Further, the rotary disc-shaped connector 30 comprises a disk body 33 and a first disc cap 34. The disk body 33 can be a hollow or solid body. The pivot connection portion 31 and the plurality of eccentric positioning portions 32 are all located on the disk body 33. The first disc cap 34 can be configured on the rotary end face on one side of the disk body 33, and covers the eccentric positioning portions 32. In the present embodiment, one end of the applied force arm 10 is integrally fixed with the first disc cap 34, and one end of the resistance force arm 20 is integrally fixed with the disk body 33. Further, the object of fixation of the applied force arm 10 and resistance force arm 20 (i.e. the first disc cap 34 and disk body 33) are interchangeable, so that the applied force arm 10 and resistance force arm are pivoted together through the disk body 33 and the first disc cap 34, and create a state with adjustable the disposing angle α. All such implementing forms are feasible.

Specifically, the first disc cap 34 is integrally formed with a first supporting portion 35 and a first limiting portion 36; the first supporting portion 35 is located at the center of the first disc cap 34, and matches one end of the pivot connection portion 31 concentrically so that they can be interconnected.

In addition, referring to FIG. 3, when the equipment to install the arm assembly offers a support shaft 41, the concentrically matching pivot connection portion 31 and the first supporting portion 35 can be presented in the form of interconnected hole-to-hole, and the bearings 31*a*, 35*a* can separately be fitted into the pivot connection portion 31 and the first supporting portion 35, so that the arm assembly can be pivoted on the support shaft 41 of the equipment through the pivot connection portion 31 and the first supporting portion 35 and can swing back and forth. Here it must be noted that, when the equipment to install the arm assembly offers a support component with a structural form other than a support shaft (such as a hole), the pivot connection portion 31 and first supporting portion 35 can also be changed accordingly to match the structural form of the support component for pivot joint (such as an axle or/and an axle sleeve). Such alterations of implementation are also covered by the scope of the present invention.

As disclosed in FIG. 2 and FIG. 3, the first limiting portion 36 is located at an eccentric position on the periphery of the first supporting portion 35, and can be aligned to the plurality of eccentric positioning portions 32 one by one along the concentric rotation path. Further, the plurality of eccentric positioning portions 32 and first limiting portion 36 can also be implemented in the form of holes, making the first limiting portion 36 to be aligned to the plurality of eccentric positioning portions 32 one by one concentrically, so that a first pin 37 can be used to go through the first limiting portion 36 and the selected eccentric positioning portion 32 to interconnect them together. One end of the first pin 37 can be installed with a grip 38 for the users to hold by hand, so that the first pin 37 can be used to fix (lock) the disposing angle α formed between the applied force arm 10 and the resistance force arm 20 already pivoted together. Specifically, the first pin 37 can be accompanied with an elastic component 39 (such as a spiral spring) when going through the holes of the first limiting portion 36 and the selected eccentric positioning portion 32.

In the embodiment disclosed in FIG. 1 to FIG. 3, the disposing angle α is adjustable, the first pin 37 and elastic component 39 are both fitted inside the first limiting portion 36. When the users select the eccentric positioning portions 32 corresponding to the required disposing angle α, the first pin 37 can released elastically and be fitted into the selected eccentric positioning portions 32 to fix (i.e. lock) the disposing angle α; when the users want to fold up the arm member or want to change the disposing angle α, the users only need to pull out the first pin 37 from the eccentric positioning portions 32 and again press it into the first limiting portion 36 or select another eccentric positioning portion 32 to change the disposing angle α. Here it must be noted that, the first limiting portion 36 and the plurality of eccentric positioning portions 32 can also be implemented in a structural form other than the hole, and the first pin 37 is also not a necessary component. For example, the first limiting portion 36 can be implemented as an elastic tenon, an elastic hook, or an elastic ball, and the plurality of eccentric positioning portions 32 can be implemented as a slot or a ball groove to receive the elastic tenon, elastic hook or elastic ball. The structural forms of the first limiting portion 36 and the plurality of eccentric positioning portions 32 are also interchangeable. All such structural designs fall within the scope of the present invention.

Figure 4:
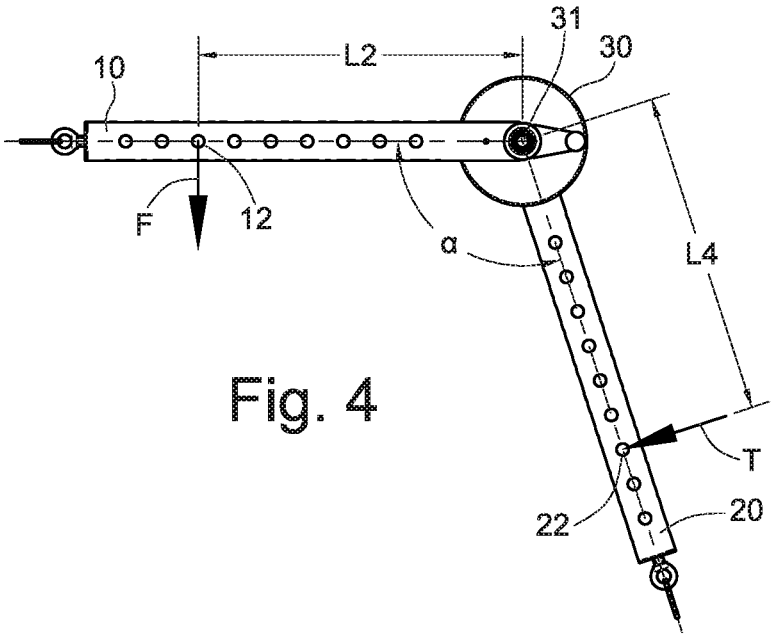
FIG. 4 is an explanatory view of the adjustable disposing angle of the arm assembly according to the present invention.

Further referring to FIG. 4, through the above implementations, the present invention enables adjustment of the disposing angle α formed between the applied force arm 10 and the resistance force arm 20, and the adjustment range covers a full 360-degree circular area. The users can select the disposing angle α between the two tension arms as required to exercise specific limbs or for specific training intensity. In this way, the users can obtain an appropriate applied force angle, an appropriate resistance force angle or an appropriate range of angles.

Referring back to FIG. 1 and FIG. 2 for further descriptions, different applied force arm lengths L1, L2 are respectively formed between the plurality of applied force assembly portions 11, 12 on the applied force arm 10 and the pivot connection portion 31; In other words, an applied force arm length L1 is formed between the applied force assembly portion 11 and the pivot connection portion 31, and an applied force arm length L2 is formed between the applied force assembly portion 12 and the pivot connection portion 31. Specifically, L1>L2 or L1<L2, but L1≠L2. Similarly, different resistance force arm length L3, L4 are respectively formed between the plurality of resistance force assembly portions 21, 22 on the resistance force arm 20 and the pivot connection portion 31; in other words, a resistance force arm length L3 is formed between the resistance force assembly portion 21 and the pivot connection portion 31, and a resistance force arm length L4 is formed between the resistance force assembly portion 22 and the pivot connection portion 31. Specifically, L3>L4 or L3<L4, but L3≠L4.

Based on such an implementation, as shown in FIG. 4, on the applied force arm 10 and the resistance force arm 20, the users can easily select the applied force assembly portion 12 of the applied force arm length L2 required and the resistance force assembly portion 22 of the resistance force arm length L4 required, and add an applied force F on the applied force assembly portion 12, and load a self-selected resistance force T on the resistance force assembly portion 22. According to the torque formula {M0=0, F×L2=T×L4}, the user's limb parts or muscle groups to add the applied force F can be trained effectively. Here, it must be noted that, the installation positions or shape forms of the applied force arm 10 and the resistance force arm 20 can be interchanged for similar training effect.

Figure 5:
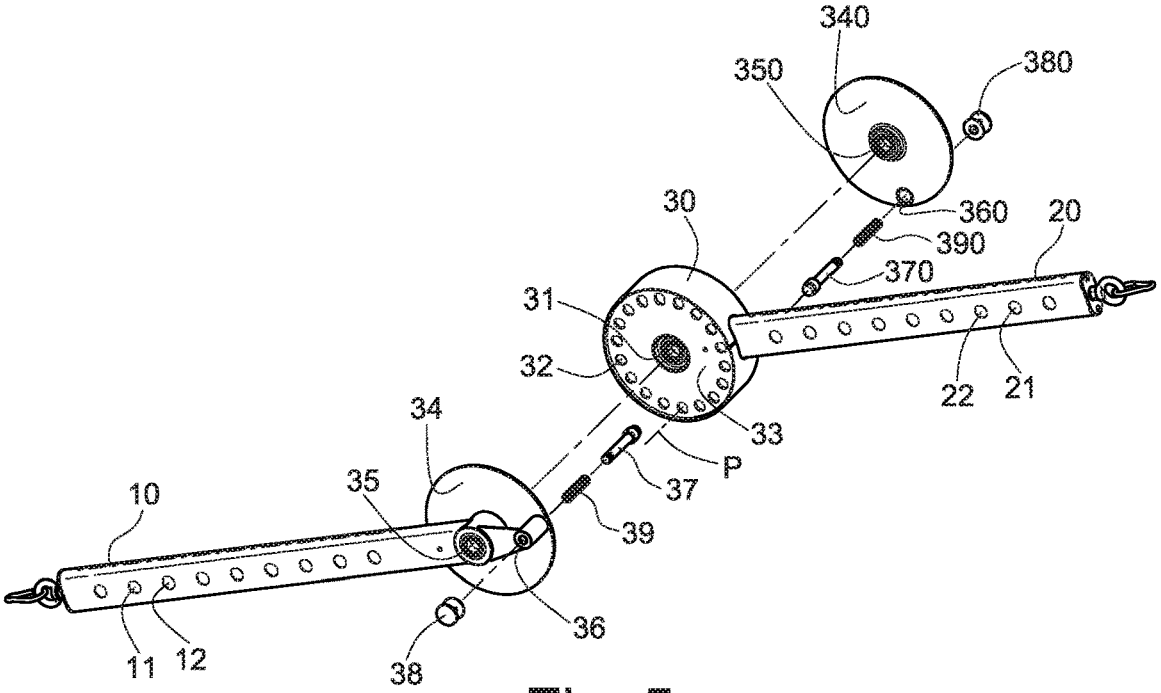
FIG. 5 is an exploded perspective view of an additional embodiment derived from FIG. 2.
Figure 6:
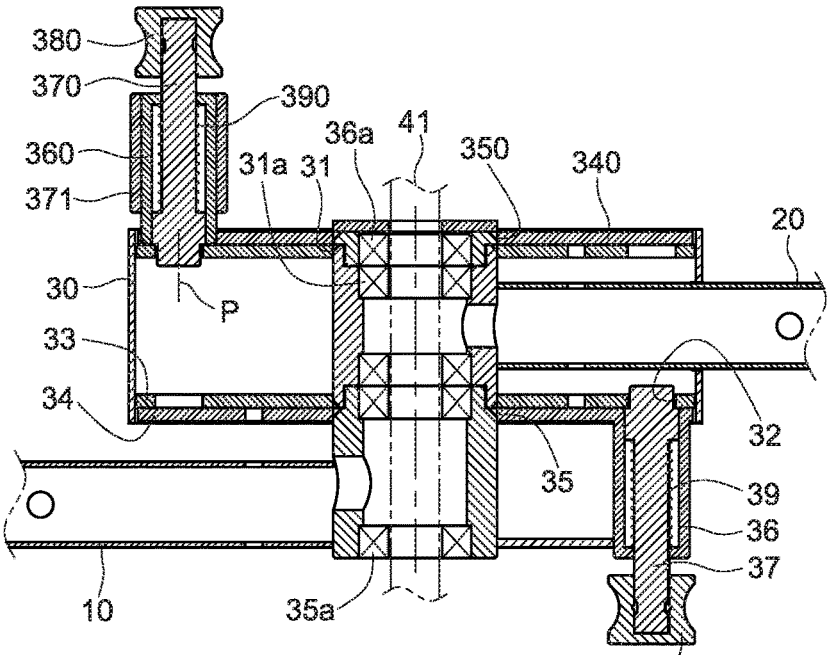
FIG. 6 is a partial sectional view of FIG. 5.

Referring collectively to FIG. 5 and FIG. 6, as disclosed in the drawings, the connector 30 can also comprise a second disc cap 340. The disc shape of the second disc cap 340 is similar to the first disc cap 34, and can be configured on the other side of the disk body 33; the second disc cap 340 is formed with holes to act as the second supporting portion 350 and the second limiting portion 360 of the embodiment. The second supporting portion 350 is located at the center of the second disc cap 340 and can be fitted with a bearing 36*a*, and is fitted concentrically on the other side of the pivot connection portion 31. When the equipment for installation of the arm assembly offers a support shaft 41, the pivot connection portion 31, the first supporting portion 35 and the second supporting portion 350 can be concentrically pivoted on the support shaft 41. Specifically, like the first supporting portion 35 mentioned above, the second supporting portion 350 can also have structural forms other than the hole.

Specifically, the second limiting portion 360 is located at an eccentric position beyond the second supporting portion 350, and can match the plurality of eccentric positioning portions 32 on the disk body 33 one by one along a rotation path of equal circumference. Thus, the second limiting portion 360 has the same positioning (locking) function as the first limiting portion 36 when selecting the required eccentric positioning portion 32. Further, the plurality of eccentric positioning portions 32 and the second limiting portion 360 can also be implemented in the form of holes, so that a second pin 370 can go through the holes of the second limiting portion 360 and the selected eccentric positioning portion 32 to interconnect them. One end of the second pin 370 can be formed with a stopping column 371, used to position (i.e. lock) the limiting point P when the stopping column 371 on the second limiting portion 360 is aligned to a required eccentric positioning portion 32. The second disc cap 340 is configured on the other side of the disk body 33 in a manner that the limiting point P can be selected. Based on such an implementation, the limiting point P provided by the stopping column 371 can control the swing angle of the arm assembly installed on fitness equipment so as to avoid collision of the arm assembly against the equipment or the body of the user. Further, the second pin 370 can also be implemented in a form similar to the first pin 37, i.e. the second pin 370 is also configured with an elastic component 390 and a grip 380.

Figure 7:
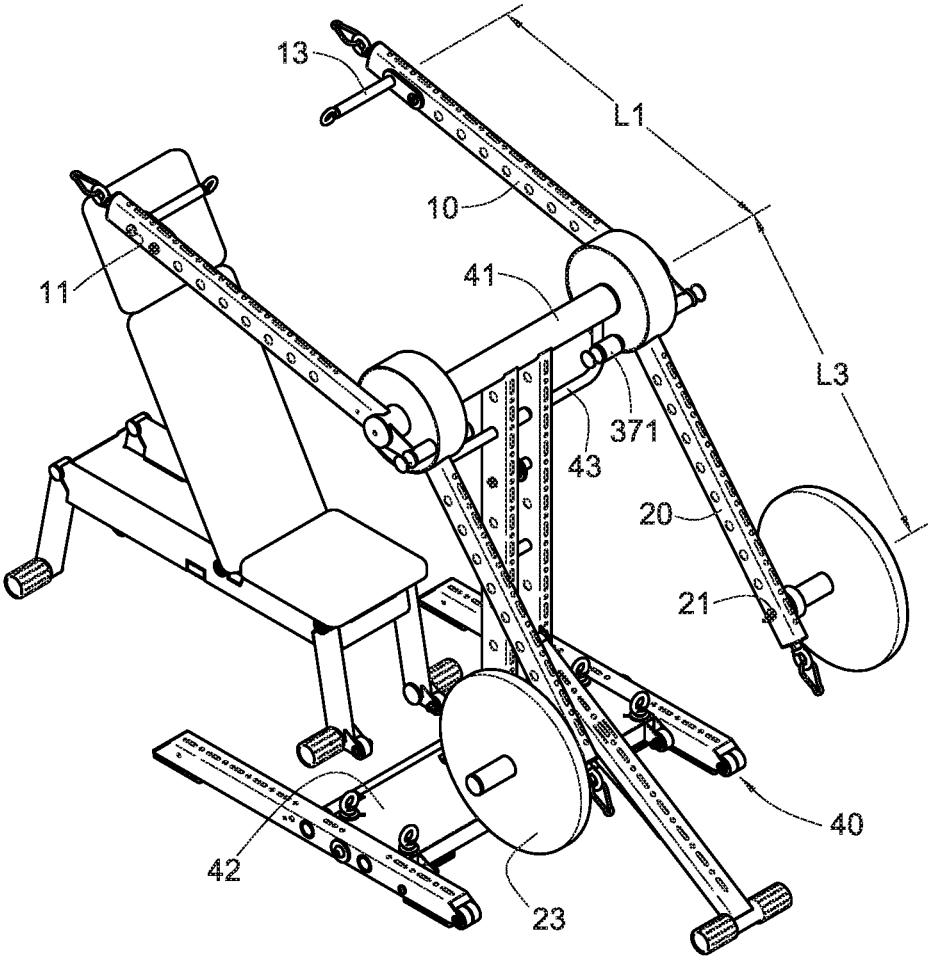
FIG. 7 is a perspective view of the present invention of an arm assembly installed on fitness equipment.

Referring to FIG. 7, the disclosed arm assembly of the present invention is installed on a fitness apparatus as the embodiment of the equipment 40 for lifting purposes. The equipment 40 provides a standing support frame 42 and the support frame 42 provides a support shaft 41; in this embodiment, two sets of arm assemblies can be applied, and can be respectively installed on both ends of the support shaft 41 as described in other embodiments above, so that the two arm assemblies are installed on the two sides of the equipment 40 symmetrically, and the users can use both hands to respectively operate one set of the arm assemblies. However, the embodiment is not limited to double-side installation.

As further disclosed in FIG. 7, the users can select the applied force assembly portions 11 on the applied force arm 10 according to required applied force arm length L1, for modular installation of an applied force member 13. Specifically, the applied force assembly portions 11 are in the form of holes, and the applied force member 13 can be any of a handle, a pedal, a bar, a mat, a frame or a rope. When the applied force assembly portions 11 is implemented in the form of holes, the applied force member 13 can be connected to the selected applied force assembly portions 11 through any of a bolt, a pin, or a hook. In the embodiment disclosed in FIG. 7, it can be assumed that the applied force member 13 is a handle for the user's limb (i.g. a hand) to touch the applied force member 13 and add an applied force F (see FIG. 4) to the arm assembly. It is to be noted, however, that the applied force assembly portions 11 can also be implemented in forms other than a hole, such as a column or a slot. As long as it is suitable for modular installation of the applied force member 13, the implementation falls within the scope of the present invention.

As further disclosed in FIG. 7, the users can select resistance force assembly portions 21 of required applied force arm length L3 on the two resistance force arms 20, for modular installation of a resistance force member 23. Specifically, the resistance force assembly portions 21 can both be implemented in the form of holes. The resistance force member 23 can be any of a weight plate, a dumbbell, an elastic rope, a hydraulic cylinder, a pneumatic cylinder, a spring, a motor, the self-weight of the user, or a water bucket to generate a pulling force upon the resistance force arm 20.

When the resistance force assembly portions 21 is implemented in the form of holes, said resistance force member 23 can be connected to or contact the selected resistance force assembly portion 21 through any of a bolt, a pin, a hook, a bar, or a rope, or, the user's body part can directly contact the resistance force assembly portions 21; specifically, when a water bucket is used as the resistance force member 23, the water bucket can be made into the form of a weight plate, so as to facilitate installation on the selected resistance force assembly portions 21. In the embodiment disclosed in FIG. 7, for example, a weight plate is used as the resistance force member 23 to load a resistance force T (see FIG. 4) to the arm assembly. When the user's limbs (e.g. hands) operates the arm assembly in a reciprocating and rotating manner, to load the resistance force generated by the resistance force member 23, the related muscle groups can be effectively trained. Specifically, during the reciprocating swing of the arm assembly, the stopping column 371 for the selected limiting point P can swing along with the arm assembly. The support frame 42 of the equipment 40 disclosed in FIG. 7 also provides a stopping portion 43 to limit the swing angle of the stopping column 371. In other words, the stopping portion 43 can be closely located at an eccentric position of the support shaft 41 to stop the stopping column 371, and to consequently limit the swing angle of the arm assembly.

Based on the embodiments described above as example, it can be easily understood that, apart from the equipment 40 shown in FIG. 7, the present invention of the arm assembly can also be modular-designed to create other style of equipment not shown in the drawings, including boating, pedaling, jogging, or lifting equipment. In other words, any object that is suitable for installation of the arm assembly, such as a door frame or a support bar or frame in other forms can all be included in the concept of equipment defined by the present invention. Only one set of arm assembly to the least is needed for the users to exercise limbs or muscle groups on one side.

Figure 8:
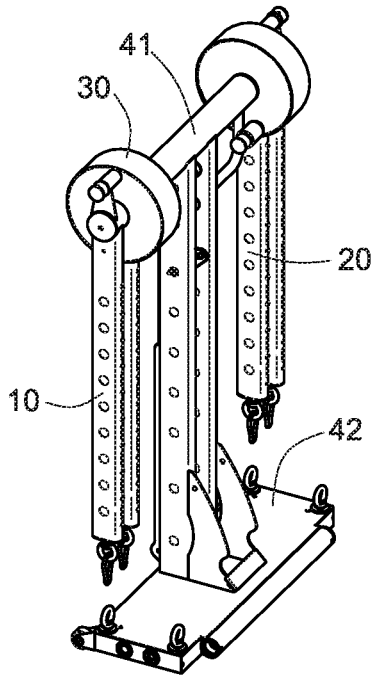
FIG. 8 is a perspective view of the present invention of an arm assembly when folded up.

Further, referring to FIG. 8, when the arm assembly is not used, the users can release the locked state of the disposing angle α and the limiting point P (see FIG. 4, FIG. 7) from the eccentric positioning portions 32, so that the arm assembly can be conveniently folded up to a state shown in FIG. 8 to save storage space.

The above descriptions of the present invention are for illustrative purpose only and are not intending to limit the scope of the invention. Technical professionals skilled in the art can make modifications, changes or equivalent designs without departing from the spirit and scope defined by the claims. All such modifications, changes or equivalent designs shall be covered by the scope of patent protection of the present invention.

The invention claimed is:

1. A mountable arm assembly for fitness equipment, comprising:

two arm members, each having an arm body with a plurality of assembly portions formed thereon in spaced arrangement such that each of the two arm members comprises a plurality of different tension arm lengths; and a connector, formed with a center-positioned pivot connection portion, and a plurality of eccentric positioning portions distributed at intervals around the center-positioned pivot connection portion;

wherein the two arm members are pivotable relative to each other through the connector, so that an adjustable disposing angle is formed between the two arm members, and at least one of the two arm members sets the adjustable disposing angle through at least one of the plurality of eccentric positioning portions, through the center-positioned pivot connection portion, wherein the mountable arm assembly is configured to be mounted on the fitness equipment and can swing back and forth, and wherein for each of the two arm members, one assembly portion of the plurality of assembly portions corresponding to one of the plurality of different tension arm lengths is selectable such that an applied force and a resistance force can be respectively added to the two selected assembly portions;

wherein said connector is made in a form of a rotary disc, said rotary disc comprises a disk body and a first disc cap, the center-positioned pivot connection portion and the plurality of eccentric positioning portions are all located on the disk body, and the first disc cap is formed with a first supporting portion and a first limiting portion;

wherein the first supporting portion is located at a center of the first disc cap and corresponds to the center-positioned pivot connection portion for interconnecting the first supporting portion, the first disc cap, and the center-positioned pivot connection portion with each other, the first limiting portion is located on a periphery of the first supporting portion and can fit onto one of the plurality of eccentric positioning portions, so that the first disc cap can be configured on a rotary end face on one side of the disk body in a manner enabling selection of the adjustable disposing angle; and wherein one end of the two arm members is fixed on the disk body and the first disc cap, such that the two arm members are pivotable relative to each other through the disk body and the first disc cap with a specific disposing angle;

wherein said connector further comprises a second disc cap, the second disc cap is formed with a second supporting portion and a second limiting portion, the second supporting portion is located at a center of the second disc cap and corresponds to the center-positioned pivot connection portion for interconnecting the second supporting portion, the second disc cap, and the center-positioned pivot connection portion with each other, the second limiting portion is located on a periphery of the second supporting portion and can fit upon one of the plurality of eccentric positioning portions, so that the second disc cap can be configured on a rotary end face on another side of the disk body in a manner enabling selection of a limiting point.

2. The mountable arm assembly for fitness equipment as claimed in claim 1, wherein the one of the two arm members corresponding to the applied force includes an applied force arm, the plurality of assembly portions on the applied force arm are respectively defined as a plurality of applied force assembly portions, the plurality of different tension arm lengths are respectively defined as a plurality of applied force arm lengths formed between the plurality of applied force assembly portions and the center-positioned pivot connection portion, and the plurality of applied force assembly portions are provided for installation of an applied force member to add the applied force to the mountable arm assembly.

3. The mountable arm assembly for fitness equipment as claimed in claim 2, wherein said applied force member is at least one of a handle, a pedal, a bar, a mat, a frame, or a rope configured for a user to contact and apply a force.

4. The mountable arm assembly for fitness equipment as claimed in claim 3, wherein said plurality of applied force assembly portions are in a form of holes, the applied force member is connected to any of the plurality of applied force arm lengths by connecting with the corresponding one of the plurality of applied force assembly portions with a bolt, a pin, or a hook.

5. The mountable arm assembly for fitness equipment as claimed in claim 1, wherein the one of the two arm members corresponding to the resistance force includes a resistance force arm, the plurality of assembly portions on the resistance force arm are respectively defined as a plurality of resistance force assembly portions, the plurality of different tension arm lengths are respectively defined as a plurality of resistance force arm lengths formed between the plurality of resistance force assembly portions and the center-positioned pivot connection portion, and the plurality of resistance force assembly portions are provided for installation of a resistance force member to add the resistance force to the mountable arm assembly.

6. The mountable arm assembly for fitness equipment as claimed in claim 5, wherein said resistance force member is at least one of a weight plate, a dumbbell, an elastic rope, a hydraulic cylinder, a pneumatic cylinder, a spring, a motor, self-weight of a user, or a water bucket to generate a pulling force upon the resistance force arm.

7. The mountable arm assembly for fitness equipment as claimed in claim 6, wherein said plurality of resistance force assembly portions are in a form of holes, the resistance force member is connected to any of the plurality of resistance force arm lengths by connecting with the corresponding one of the plurality of resistance force assembly portions with a bolt, a pin, a hook, a bar, a rope, or a part of a body of the user.

8. The mountable arm assembly for fitness equipment as claimed in claim 1, wherein said first supporting portion and the first limiting portion are integrally formed with an end portion of the arm member that is fixed on the first disc cap.

9. The mountable arm assembly for fitness equipment as claimed in claim 8, wherein the center-positioned pivot connection portion and the first supporting portion can be presented as a pivot joint having an interconnected hole-to-hole form, wherein the pivot joint comprises a support shaft for pivoting with the center-positioned pivot connection portion.

10. The mountable arm assembly for fitness equipment as claimed in claim 8, wherein said first limiting portion and the plurality of eccentric positioning portions are configured in a form of matching holes, so that the first limiting portion and the plurality of eccentric positioning portions can be fixed together through a first pin going through a selected one pair of the matching holes to define the adjustable disposing angle.

11. The mountable arm assembly for fitness equipment as claimed in claim 10, wherein said first pin is accompanied with an elastic component when going through the matching holes of the first limiting portion and the plurality of eccentric positioning portions to fix them together.

12. The mountable arm assembly for fitness equipment as claimed in claim 1, wherein the center-positioned pivot connection portion and the second supporting portion can be presented as a pivot joint having an interconnected hole-to-hole form, wherein the pivot joint comprises a support shaft for pivoting with the center-positioned pivot connection portion and the second supporting portion.

13. The mountable arm assembly for fitness equipment as claimed in claim 1, wherein said second limiting portion and the plurality of eccentric positioning portions are configured in a form of matching holes, so that the second limiting portion and the plurality of eccentric positioning portions are interconnected via a second pin to determine the limiting point.

14. The mountable arm assembly for fitness equipment as claimed in claim 13, wherein one end of the second pin extends outward to form a stopping column, so that the stopping column can swing along with the mountable arm assembly, wherein the fitness equipment is configured to comprise a stopping portion that can limit a swing angle of the stopping column, the stopping portion is located at a close eccentric position on the support shaft.

15. The mountable arm assembly for fitness equipment as claimed in claim 1, wherein said mountable arm assembly is a pair of mountable arm assemblies configured to be symmetrically installed on two sides of the fitness equipment.

16. The mountable arm assembly for fitness equipment as claimed in claim 1, wherein said fitness equipment is any of a fitness apparatus, a support frame, and a door frame.

* * * * *